United States Patent [19]

Rainey

[11] 4,445,689

[45] May 1, 1984

[54] MARBLE PLAYING COURT

[76] Inventor: Judson C. Rainey, 2501 Halsel St., Rte. 7, Gulfport, Miss. 39503

[21] Appl. No.: 120,647

[22] Filed: Feb. 11, 1980

[51] Int. Cl.[3] ..... A63F 7/00

[52] U.S. Cl. ..... 273/118 R

[58] Field of Search ..... 273/118 R, 119 R, 123 R, 273/309

[56] References Cited

U.S. PATENT DOCUMENTS

| | | | |
|---|---|---|---|
| 723,378 | 3/1903 | Fuller | 273/8 UX |
| 1,655,607 | 1/1928 | Hueter | 273/309 |
| 2,371,262 | 3/1945 | Polis | 273/309 |
| 2,468,194 | 4/1949 | Hall | 273/85 R X |
| 2,621,931 | 12/1952 | Kennon | 273/127 R X |
| 2,639,151 | 5/1953 | Kennon | 273/118 R |

*Primary Examiner*—Anton O. Oechsle

[57] ABSTRACT

A marble playing court has a mat of a firm flexible material having a portion thereof indicating a marble shooting ring, and a peripheral edge, and at least the portion of the surface of the mat within the marble shooting ring has a surface texture simulating dirt. The playing court further includes a plurality of border members around the periphery of the mat, the base of the border members being an extension of the upper surface of the mat, and the border members further having on the outer edge thereof an upwardly and inwardly extending marble blocking wall. The ends of the border members abut and are interlocked with the ends of the adjacent member to form a frame completely enclosing the mat.

15 Claims, 11 Drawing Figures

MARBLE PLAYING COURT

The present invention relates to a marble playing court, and more particularly to such a marble playing court which simulates a marble game surface, such as a marble shooting ring, having a dirt surface, yet which can be placed on a supporting surface which itself is not suitable for a marble game, such as a table or a concrete floor or the like so that the game can be played anywhere such a supporting surface is available.

BACKGROUND OF THE INVENTION

Marble games have been developed to an extensive degree, and the traditional game in which marbles are knocked out of a ring by shooting other marbles is now a tournament game played according to strict rules. This and other marble games are traditionally played on a dirt surface, and the traditional game has a marble shooting ring marked on the dirt surface. While this is satisfactory when weather conditions are good, it is obviously not possible to use such a dirt surface, at least outdoors, when the weather is inclement. Moreover, it is not the type of game which can ordinarily be played indoors in a home or school or the like. It is impractical to prepare a dirt surface on a floor or a table or the like, except where special structure is provided for this purpose.

OBJECT AND BRIEF SUMMARY OF THE INVENTION

It is the object of the present invention to provide a marble playing court which can be placed on any available flat supporting surface so that marble games, traditional and otherwise, can be played indoors or even outdoors where a conventional dirt surface is not readily available.

It is a further object of the present invention to provide such a marble playing court which can be easily assembled and disassembled so that it can be used on a floor or concrete slab, or in the surface of a piece of furniture such as a table, yet can be easily removed from the supporting surface and stored so that the surface can be used for some other purpose.

It is a still further object of the invention to provide such a marble playing court which includes means for retaining the marbles so that they do not roll away from the immediate vicinity of the playing court or, where the supporting surface is elevated, such as a table, they do not fall off the supporting surface.

These objects are achieved by the provision of a marble playing court according to the present invention, which has a mat of a firm flexible material having a portion thereof indicating the indicia for a marble game, such as a marble shooting ring, and having a peripheral edge, and with at least the portion of the surface of the mat within the indicia having a surface texture simulating dirt. The playing court further includes a plurality of border members around the periphery of the mat, the base of the border members being an extension of the upper surface of the mat, and the border members further having on the outer edge thereof an upwardly and inwardly extending marble blocking wall. The ends of the border members abut and are interlocked with the ends of the adjacent members to form a frame completely enclosing the mat.

BRIEF DESCRIPTION OF THE FIGURES

The invention will now be described in greater detail hereinafter, in connection with the accompanying drawings, in which:

FIG. 6 is a sectional elevation view of a third embodiment of the marble playing court according to the invention with a border member moved away from the edge of the mat;

DETAILED DESCRIPTION OF THE DRAWINGS

Figure 1:
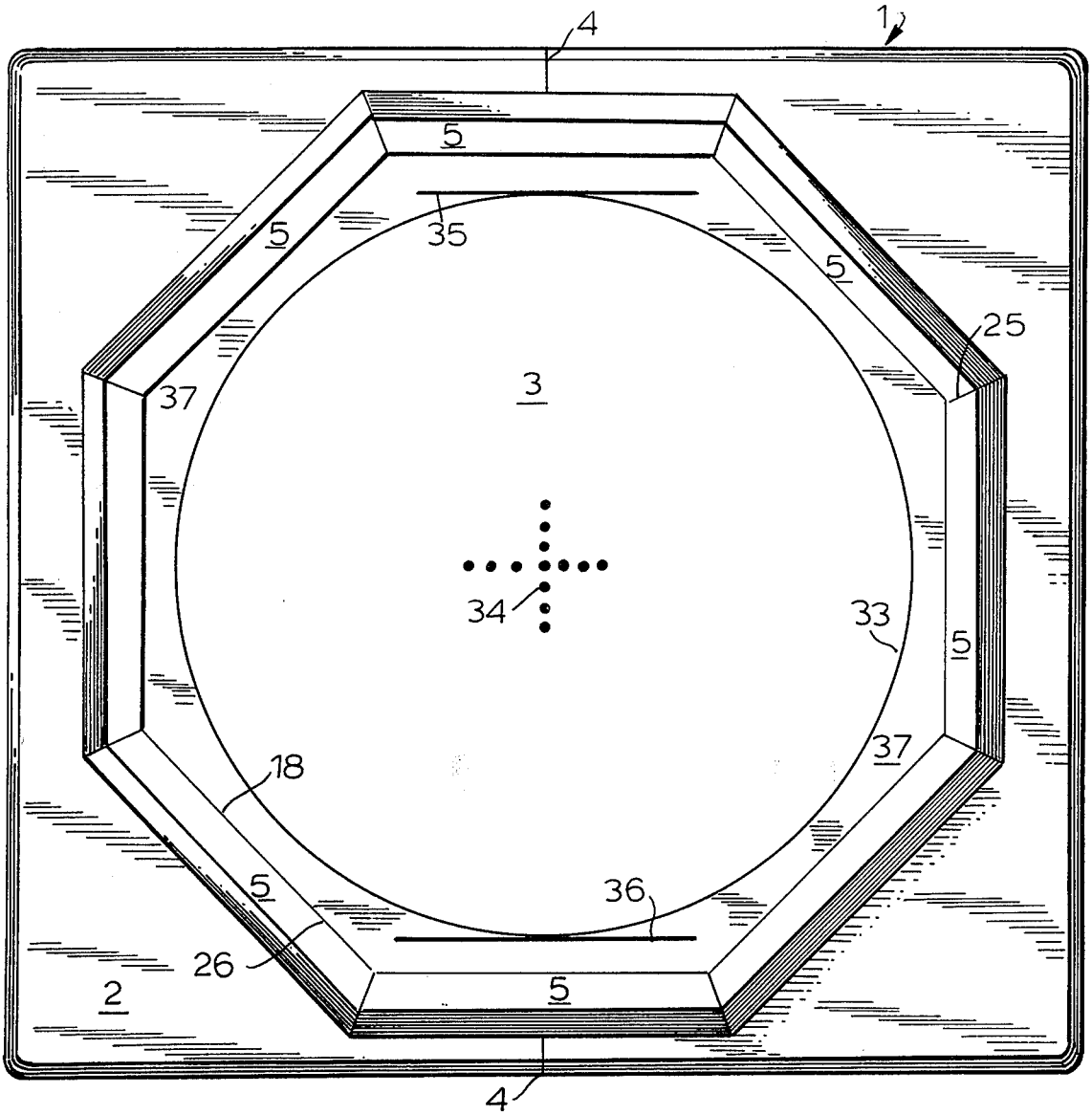
FIG. 1 is a top plan view of a first embodiment of a marble playing court supported on a table.
Figure 2:
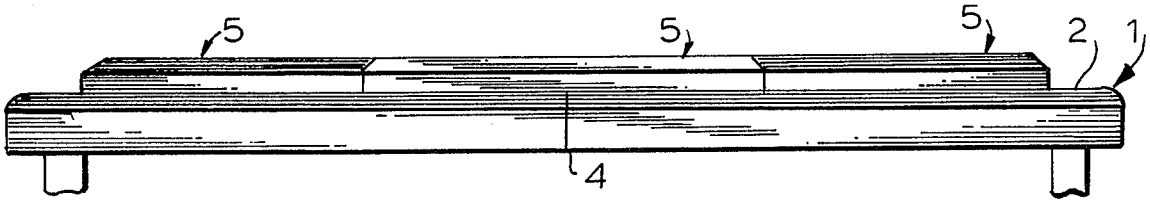
FIG. 2 is a side elevation view of the marble playing court shown in FIG. 1.

The first embodiment of the marble playing court according to the present invention, as shown in FIGS. 1–5 is comprised of a mat 3 of a firm flexible material such as vinyl, and having on the upper surface thereof a portion 33 thereof which is part of the indicia for a marble game, here shown as a marble shooting ring for the traditional marble game. Where, as in this embodiment, the surface outside the ring is level with the surface within the ring, the portion 33 can be a line inscribed in the material of the mat, but not so deep or wide as to interfere with the roll of the marbles. The mat 3 has a peripheral edge 18, and at least the portion of the surface of the mat within the marble shooting ring 33 has a surface texture simulating dirt. In the embodiment of FIGS. 1–5 the entire upper surface of the mat has such a surface texture. The upper surface of the mat further has indicia 34–36 thereon, here shown as markings necessary for playing American Ringer National Tournament Marbles. Similar indicia may be provided for National or International tournament type marble games. The markings consist of a center cross formed of a plurality of spot marks, a lag line and a pitch line, both tangent to the ring line 33 and diametrically opposite each other.

The mat 3 is here shown as being supported directly on the upper surface 2 of a conventional table top 1 and the mat is sufficiently firm so that even though it lies across a joint 4 between the halves of the table top, there is no corresponding discontinuity in the upper surface of the mat, which remains perfectly smooth and level. The mat is also suitable for placing on other types of surfaces which do not have a proper dirt texture such as a hardwood or tile floor, asphalt paving, or a concrete slab, and in such a case the top surface will be smooth despite minor irregularities in the underlying surface. The mat is also preferably sufficiently firm, that is when it is on a floor, paving or slab or the like and a player walks on, kneels or otherwise exerts force on the mat tending to distort or wrinkle it, the mat will not distort or wrinkle.

The marble playing court further comprises a plurality of border members 5 assembled in a frame around the periphery of the mat. In the present embodiment, the mat has an octangular peripheral edge 18, and there are 8 such border members, each having a mitered end which abuts closely with the ends of adjacent border members.

Figure 3:
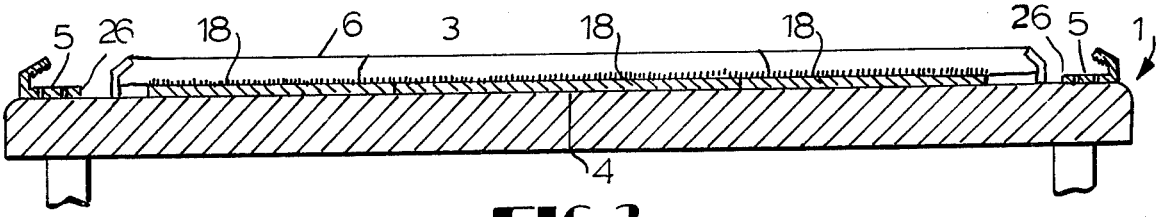
FIG. 3 is a sectional view of the marble playing court as shown in FIG. 2, with certain of the border members moved away from the edge of the mat.
Figure 4:
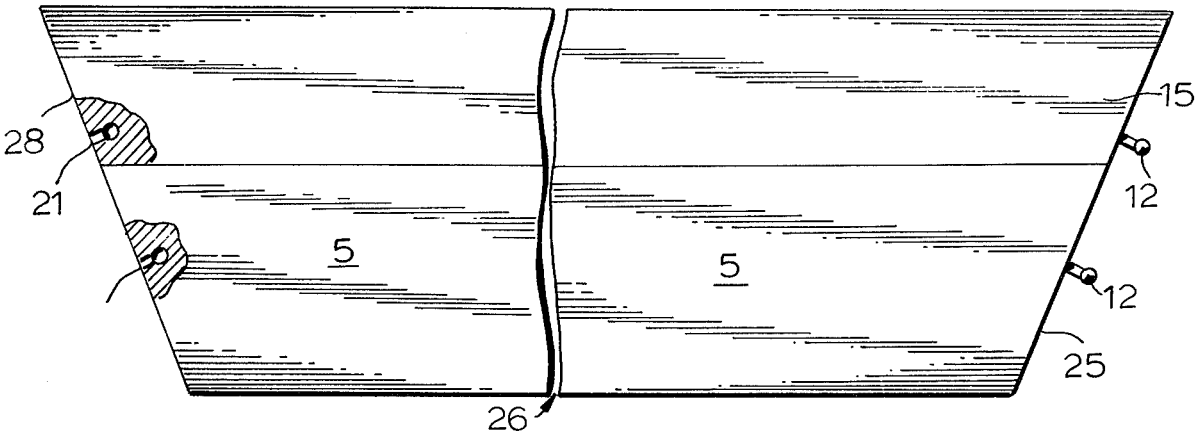
FIG. 4 is a plan view on a larger scale and partially broken away and partially in section, showing one of the border members.
Figure 5:
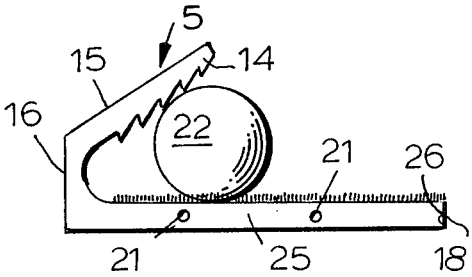
FIG. 5 is an end view of the border member of FIG. 4.

Each border member, as seen most clearly in FIGS. 3–5 is comprised of a base 25 which has upper surface 25A which, at the inner edge thereof, is level with the upper surface of the mat at the periphery of the mat. The border member also has an inner edge 26 complementary in shape to and abutting a portion of the peripheral edge 18 of the mat. In the present embodiment the octogonal sides of the mat are straight, so that the edges 26 of the border members are also straight. When the border members are assembled in a frame around the mat, the upper surfaces of the respective border members define with the mat an extension of the marble playing surface.

Each border member further has, on the outer edge of the base, an upwardly and inwardly extending marble blocking wall constituted by a vertical portion 16 and an upwardly and inwardly extending portion 15. On the inwardly and downwardly facing surface of the upwardly and inwardly extending portion 15 is a plurality of downwardly and outwardly extending serrations 14. The border sections 5 are preferably made of a firm but flexible resilient material such as vinyl or a similar substance, so that when a marble 22 simply strokes the border section, the impact is absorbed with the marble does not bounce off where the impact is a strong impact, the marble rolls under the inwardly and upwardly extending portion 15, and it is held against rolling out from under this portion by the serrations 14.

Each border member 5 has an engaging means at each end thereof for engaging complementary engaging means on the abutting ends of the adjacent border members 5. In the embodiment shown in FIGS. 1–5, this engaging means is in the form of snap fitting projections 12 on one end of the base of the border member, and projection receiving recesses 21 on the other end of the base of the border member. In this embodiment there are no engaging means on the abutting ends of the portions 15 and 16.

From the foregoing description of the construction of the marble playing court according to the invention, it will be readily understood that the playing court can be easily assembled simply by laying the mat 3 flat on the upper surface 2 of the table 1 or other supporting surface, and snapping the border sections 5 together with the inner edges 26 abutted against the outer edge 18 of the mat 3 so as to form a frame completely enclosing the mat 3. When the players are finished using the playing court, it can be readily disassembled and stored and the surface can be used for other purposes, e.g. the table can be used as a normal table.

Further, because of the upwardly and inwardly extending marble blocking wall 15, 16 on the peripheral edge of the border members, marbles 22 are prevented from escaping from the playing court if they roll to the border members, and are also prevented from rolling back into the ring.

Players can walk, kneel or crawl on the mat itself during the play of the game, and the mat will not distort or wrinkle, thus leaving undisturbed the marbles in play in the game. Moreover, because the blocking walls 15, 16 on adjacent border members are not connected, if a player steps on one, it will deform without affecting adjacent blocking walls, and when the deforming force is removed, the blocking wall will return to its normal shape.

Figure 6:
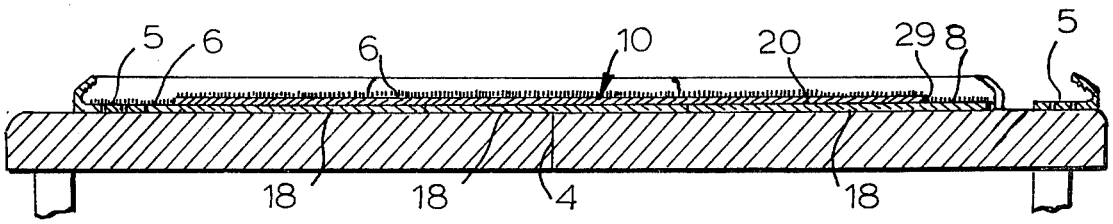
FIG. 6 is a sectional elevation view of a second embodiment of the marble playing court according to the invention, with one border member moved away from the edge of the mat.

The embodiment of the playing court shown in FIG. 6 differs from that shown in FIGS. 1–5 in that the mat 3 has a shape which provides an upper level 10 in the center of the mat, the edge 29 of which constitutes the ring line 33, and the mat has a lower level 8 around the periphery of the upper level constituting part of the area around the outside of the ring 33. The upper surface of the base portion of the border members is level with the surface 8 of the lower level of the mat 3. The upper surface of both the upper level 10 and the lower level 8 is a simulated dirt surface 6, as in the embodiment of FIGS. 1–5. The remainder of the portions of the playing court are the same as those of the embodiment of FIGS. 1–5, and they will not be described further.

Figure 7:
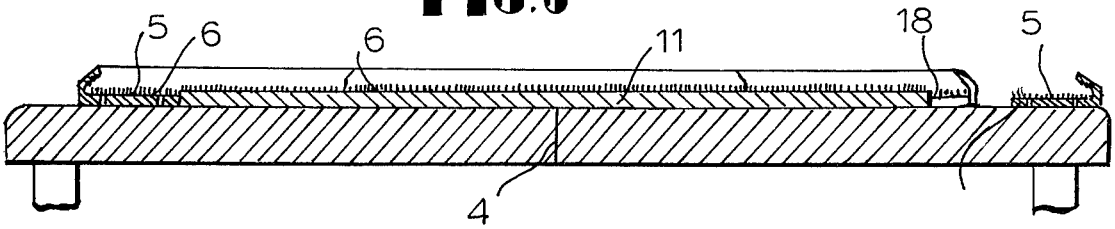
Figure 8:
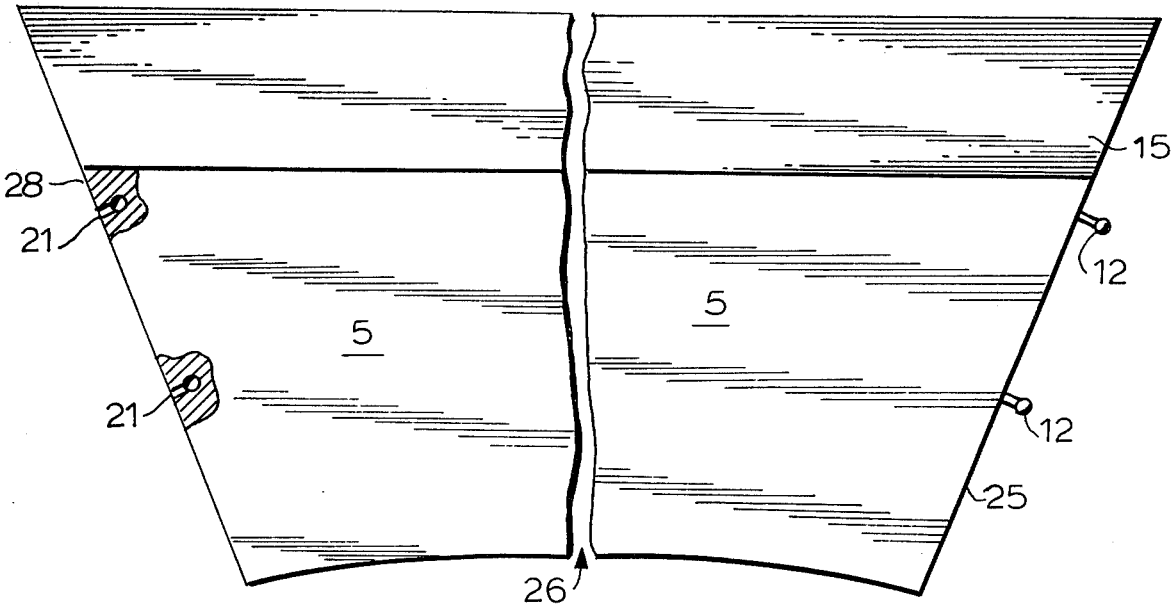
FIG. 8 is a plan view, on an enlarged scale and partially broken away and partially in section, showing one of the border members of the embodiment of FIG. 7.
Figure 9:
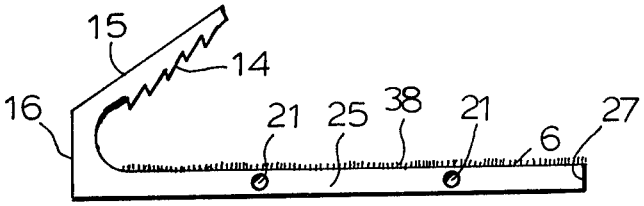
FIG. 9 is an end elevation view of the border member shown in FIG. 8.

It will be understood that in this embodiment, by providing a change in level between portions of the playing court within and without the ring 33, it will be clear when a marble has rolled out of the ring, since it will drop from the upper level 10 to lower level 8, thereby preventing disputes over whether a marble has rolled out of the ring 33. This construction also prevents marbles from rolling back into the ring 33 once they have dropped off the upper level 10. The embodiment shown in FIGS. 7–9 is somewhat similar to the embodiment shown in FIG. 6 in that a change of level is provided along the ring line. However, the structure for achieving this is somewhat different from the embodiment of FIG. 6. It will be seen that the mat 3 is constituted by a single thickness of material 11, which is circular in shape, and which has a thickness substantially the same as the thickness of the portion of the mat in the embodiment of FIG. 6 which is within the ring 33. The peripheral edge 18 of the mat lies along the ring 33.

The border members 5 of this embodiment, on the other hand, have the inner peripheral edge 27 of the base shaped in a shape complementary of the peripheral edge 18 of the mat 11, i.e. in the shape of an arc of a circle. The thickness of the base portion of these border members is less than the thickness of the mat portion 11, so that there is a change in level between the upper surface of the mat portion 11 and the upper surface of the base of the border members 5.

Otherwise, the structure of the embodiment of FIGS. 7–9 is the same as that of FIGS. 1–5, and no further description thereof will be given.

Figure 10:
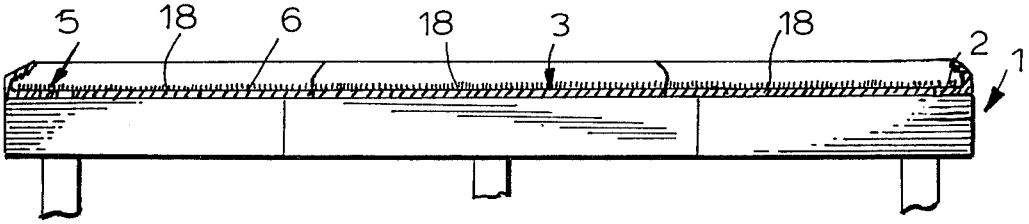
FIG. 10 is a side elevation view of a further embodiment of the marble playing court according to the present invention with one of the border members removed.

FIG. 10 shows a further embodiment of the playing court of the present invention, in which the structure of the playing court itself is the same as the embodiment of FIGS. 1–5, but it is supported on a table 1 having a top with the same shape as the peripheral shape of the frame defined by the border members 5. Such a table is normally a special purpose table suitable only for supporting a playing court of this type, or some other game apparatus having the same peripheral shape.

Figure 11:
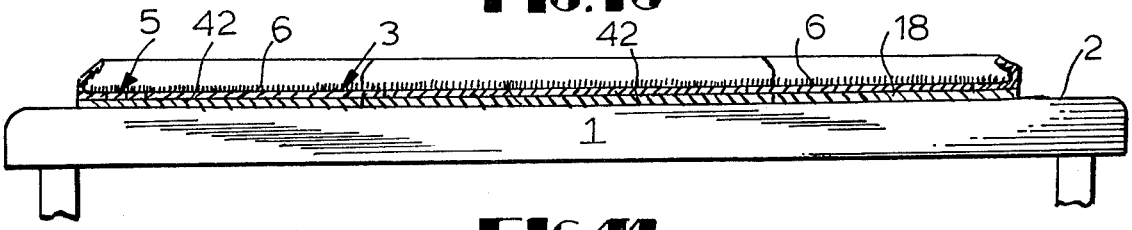
FIG. 11 is a sectional elevation view of a still further embodiment of the marble playing court of the present invention with a border member removed.

The embodiment of FIG. 11 is similar to that of FIGS. 1–5, but in addition it includes a rigid multi-section support which is a plane flat member 42 having at least one joint therein, for example extending diametrically across the support, and made of a material such as plywood, so-called particle board, plastic or the like, to provide additional support for the mat 3 when it is placed on the upper surface 2 of a supporting structure such as a table 1. Otherwise, the embodiment is the same as that of FIGS. 1–5, and no further description thereof will be given.

It will thus be seen that there has been provided a marble playing court which achieves all the objects set forth above. It is simple and convenient to set up on any appropriate supporting surface, particularly a table having a joint thereacross, and gives an accurate simulation of a marble playing court of dirt. When the players are finished using the playing court, it can be easily disassembled and stored, so that the surface of the table is free for other uses.

It will of course be understood that the invention is not limited to the precise embodiments shown. For example, the octagonal shape of the mat and the frame formed by the border members 5 as shown in the Figures has been chosen because when the mat is rolled up starting from one of the side edges, the ends of the resulting roll will be flat, being defined by the coiled edges which are perpendicular to the side edge from which the roll was started. This facilitates storage, enabling the rolled mat to be stood on end. However, greater or lesser number of sides can be provided, and the periphery of the mat can be any other convenient shape, in which case the frames will have inner edges complementary to such a shape. The mat can be made of any other material which provides a satisfactory simulation of a dirt surface and is sufficiently rigid, and the border members can be made of other materials which provide the desired action when a marble strikes than or rolls under the upwardly and inwardly extending portion 15. Other types of engaging means than the snap fitting projections and recesses can be provided to engage the ends of the border members 5 with the next adjacent border members. Finally, the support 42 for the mat shown in the embodiment of FIG. 11 can have a plurality of sector-shaped sections rather than two halves, thus making the support more convenient to store.

What is claimed is:

1. A marble playing court comprising:

a mat of a firm flexible material having a peripheral edge; and a plurality of border members around the periphery of said mat, each border member having a base which has an upper surface at the inner edge thereof level with the upper surface of the mat at the periphery thereof and forming a continuation thereof and having an inner edge complementary in shape to and abutting a portion of the peripheral edge of said mat to define with said mat a marble playing surface, said marble playing surface having indicia for a marble game thereon, each border member further having an upwardly and inwardly extending marble blocking wall on the outer edge of said base, the ends of said border members abutting the ends of adjacent border members to form a frame completely enclosing the mat and having engaging means engaging complementary engaging means on the abutting ends of adjacent border members.

2. A marble playing court as claimed in claim 1 in which said indicia is a marble shooting ring on said mat, at least the portion of the surface of said mat within said ring having a surface texture simulating dirt.

3. A marble playing court as claimed in claim 2 in which the upper surface of said mat has a single level and said shooting ring is a surface indicia on said upper surface of said mat.

4. A marble playing court as claimed in claim 2 in which the upper surface of said mat has an upper level in the center thereof and a lower level around the periphery of said upper level, and an edge substantially perpendicular to said surface between said upper and lower levels constituting said indicia defining said shooting ring.

5. A marble playing court as claimed in claim 1 in which the peripheral edge of said mat is in the shape of an octagon and there are eight border members each of which is straight and has a straight inner edge.

6. A marble playing court as claimed in claim 1 in which the under surface of each upwardly and inwardly extending marble blocking wall has a plurality of downwardly extending serrations thereon for engaging a marble thereunder and preventing it from rolling out from under said upwardly and inwardly extending marble blocking wall.

7. A marble playing court as claimed in claim 1 in which said border members are made of a flexible and resilient material and said engaging means are only on the abutting ends of said basis of said border members, whereby the marble blocking walls are free to deform downwardly and return to their original shape independently of adjacent blocking walls.

8. A marble playing court as claimed in claim 1 in which said material of said mat is sufficiently firm not to distort or wrinkle when walked, kneeled or crawled on by a player.

9. A marble playing court as claimed in claim 1 further comprising a rigid multi-section support having a peripheral shape the same as the peripheral shape of the assembled border members and on which said mat and border members are supported.

10. A marble playing court comprising:

a mat of a firm flexible material having a peripheral shape defining a marble playing area; and a plurality of border members around the periphery of said mat, each border member having a base which has a upper surface at the inner edge thereof at a level lower than the upper surface of the mat at the periphery thereof and having an inner edge complementary in shape to the abutting portion of the peripheral edge of said mat to define with said said mat a marble playing surface, said marble playing surface having indicia for a marble game thereon, each border member further having an upwardly and inwardly extending marble blocking wall on the outer edge of said base, the ends of said border members abutting the ends of adjacent border members to form a frame completely enclosing the mat and having engaging means engaging complementary engaging means on the abutting ends of adjacent border members.

11. A marble playing court as claimed in claim 10 in which the periphery of said mat defines a ring and the surface of said mat having a surface texture simulating dirt.

12. A marble playing court as claimed in claim 10 in which there are eight border members each of which is straight and together forming an octagonal frame.

13. A marble playing court as claimed in claim 10 in which the under surface of each upwardly and inwardly extending marble blocking wall has a plurality of downward serrations thereon for engaging a marble thereunder and preventing it from rolling out from under upwardly extending marble blocking wall.

14. A marble playing court as claimed in claim 10 in which said border members are made of a flexible and resilient material and said engaging means are only on the abutting ends of said basis of said border members, whereby the marble blocking walls are free to deform downwardly and return to their original shape independently of adjacent blocking walls.

15. A marble playing court as claimed in claim 10 further comprising a rigid multi-section support having a peripheral shape the same as the peripheral shape of the assembled border members and on which said mat and border members are supported.

* * * * *

UNITED STATES PATENT AND TRADEMARK OFFICE

CERTIFICATE OF CORRECTION

PATENT NO. : 4,445,689

DATED : May 1, 1984

INVENTOR(S) : Judson C. Rainey

It is certified that error appears in the above-identified patent and that said Letters Patent is hereby corrected as shown below:

The term of this patent subsequent to February 1, 1999, has been disclaimed.

Signed and Sealed this

*Eighteenth* Day of *September 1984*

[SEAL]

*Attest:*

GERALD J. MOSSINGHOFF

*Attesting Officer*

*Commissioner of Patents and Trademarks*